US005984655A

United States Patent [19]

Schwenninger et al.

[11] Patent Number: 5,984,655

[45] **Date of Patent: *Nov. 16, 1999**

[54] SPINNING PROCESS AND APPARATUS

[75] Inventors: Franz Schwenninger, Lenzing; Friedrich Ecker, Timelkam; Wilhelm Feilmair, Lenzing; Christoph Schrempf, Bad Schallerbach; Heinrich Firgo, Vöcklabruck; Stefan Zikeli, Regau; Ernest Rauch, Schörfling, all of Austria

[73] Assignee: Lenzing Aktiengesellschaft, Lenzing, Austria

[ * ] Notice: This patent issued on a continued prosecution application filed under 37 CFR 1.53(d), and is subject to the twenty year patent term provisions of 35 U.S.C. 154(a)(2).

[21] Appl. No.: 08/726,580

[22] Filed: Oct. 7, 1996

Related U.S. Application Data

[63] Continuation-in-part of application No. 08/476,603, Jun. 6, 1995, abandoned.

[30] Foreign Application Priority Data

Dec. 22, 1994 [AT] Austria ..... 2391/94
Nov. 27, 1995 [AT] Austria ..... 1935/95

[51] Int. Cl.[6] ..... B29C 47/12

[52] U.S. Cl. ..... 425/71; 425/72.2; 425/464

[58] Field of Search ..... 264/203, 184, 264/187, 178 R; 425/69, 71, 72.2, 464

[56] References Cited

U.S. PATENT DOCUMENTS

| | | | |
|---|---|---|---|
| 2,246,990 | 6/1941 | Wuppermann | 425/69 |
| 2,453,839 | 11/1948 | Furness | 425/69 |
| 2,988,418 | 6/1961 | Finlayson | 264/184 |
| 3,210,452 | 10/1965 | Howard | 264/203 |
| 3,946,094 | 3/1976 | Kanetsuna et al. | 264/178 F |
| 4,446,089 | 5/1984 | Strehler et al. . | |
| 4,971,539 | 11/1990 | Luckey | 425/69 |
| 5,178,814 | 1/1993 | Lemond | 425/72.2 |
| 5,234,651 | 8/1993 | Kawai | 264/184 |
| 5,252,284 | 10/1993 | Jurkovic et al. | 264/187 |
| 5,589,125 | 12/1996 | Zikeli et al. | 264/187 |
| 5,650,112 | 7/1997 | Zikeli et al. | 264/187 |
| 5,658,524 | 8/1997 | Portnoy et al. | 264/186 |

FOREIGN PATENT DOCUMENTS

| | | | |
|---|---|---|---|
| 397392 | 3/1994 | Austria . | |
| 086426 | 2/1983 | European Pat. Off. . | |
| 574870 | 12/1993 | European Pat. Off. . | |
| 2913589 | 4/1979 | Germany . | |
| 218121 | 1/1985 | Germany . | |
| 4519413 | 7/1970 | Japan | 264/184 |
| 1017855 | 6/1964 | United Kingdom . | |
| WO94-28218 | 8/1984 | WIPO . | |
| WO93-12930 | 9/1993 | WIPO . | |

*Primary Examiner*—Jay H. Woo
*Assistant Examiner*—Robert A. Hopkins
*Attorney, Agent, or Firm*—Baker & Botts LLP

[57] ABSTRACT

Spinning apparatus for carrying out a dry/wet-spinning process includes a spinneret for extruding filaments, a blowing device whereby the extruded filaments may be cooled immediately after being delivered from the spinning holes, a container containing spinning bath liquid, and means for bundling the extruded filaments provided in the spinning bath liquid. Preferably, the same means serves both for bundling and diverting the extruded filaments and is non-rotatable.

22 Claims, 4 Drawing Sheets d1
d0
3
h
l
α
5
4
2
1a
1

7
3
α
l
6
h
1
2

SPINNING PROCESS AND APPARATUS

This application is a continuation-in-part of U.S. application Ser. No. 08/476,603 filed Jun. 6, 1995.

BACKGROUND OF THE INVENTION

The invention relates to a spinning process and apparatus for carrying out an amine-oxide process according to the dry/wet-spinning process. The spinning apparatus comprises a spinneret having spinning holes for extruding filaments, a container for holding spinning bath liquid, an air gap defined as the distance between the spinneret and the surface of the spinning bath liquid and a shaped body supported in the container of spinning bath liquid for bundling and diverting the extruded filaments.

In general terms, in the dry/wet spinning process, the spinning dope is extruded through a forming tool, such as a spinneret, to form filaments or other shaped bodies. The extruded bodies are then exposed to a non-precipitating medium such as air or an inert gas. In the case of filaments, the filaments are stretched in the air or inert gas medium and subsequently conducted into a spinning bath liquid (precipitation bath), wherein the filaments coagulate.

The amine-oxide process according to the dry/wet-spinning process is known from DE-A -29 13 589. Generally, the amine-oxide process involves the production of cellulose molded bodies using tertiary amine-oxides. According to this process, cellulose is dissolved in a mixture of water and a tertiary amine-oxide to form a solution. N-methylmorpholine-N-oxide (NMMO) is primarily used as the amine-oxide. Other amine-oxides are described in, e.g., EP-A -0 553 070. A process for the production of moldable cellulose solutions is disclosed in EP-A-0 356 419, (U.S. Pat. No. 5,094,690).

WO 93/19230 and WO 95/04173 disclose an advantageous embodiment of the amine-oxide process and a device for the production of cellulose fibers. A solution of cellulose in a tertiary amine-oxide is molded in a hot state, and the molded solution is then introduced through a gaseous medium (air) into a precipitation bath to precipitate the cellulose therein. The hot, molded solution is cooled before it is introduced into the precipitation bath. The cooling is carried out immediately after the molding by blowing air on the molded cellulose filaments in a direction which is generally perpendicular to the direction of travel of the filaments. The process enables the cellulose solution to be spun with a high filament density, while preventing adhesion between the individual filaments after they are extruded from the spinneret.

DD-A -218 121 discloses another dry/wet-spinning process for the production of cellulose fibers from solutions of cellulose in tertiary amine-oxides. The cellulose solution is spun into an air gap, i.e. the space between the spinneret and the surface of the spinning bath liquid, stretched and conducted into an aqueous precipitation bath. According to DD-A - 218 121, the air gap may be reduced without any negative effects on the spinning safety if a polyalkylene ether is added to the cellulose solution before commencement of the spinning operation. The small air gap reduces the risk of adhesion between the freshly extruded filaments.

EP-A-0 574 870 discloses yet another dry/wet-spinning process for processing solutions of cellulose in tertiary amine-oxides and points out the advantage of a small air gap. According to the disclosure, adhesion between the individual filaments during the spinning operation is prevented even though the spinning process employs a small air gap and a high number of spinning holes per area unit, by directing the filaments through a spinning funnel and into the spinning bath liquid. Spinning bath liquid flows through the spinning funnel in a direction parallel to the flow of the filaments. The longitudinal axis of the spinning funnel is substantially vertical, i.e. perpendicular to the plane of the spinneret. The flow of the spinning bath liquid is directed downwards from above and is generated from the gravitational fall of the spinning bath liquid. The drawing or stretching of the extruded filaments is accomplished by the flow of the spinning bath liquid through the spinning funnel.

There are a number of problems associated with the spinning device disclosed in EP-A 0 574 870. First, the small diameter of the spinning funnel sets an upper limit on the number of filaments which can be conducted through the funnel at any one time. This upper limit prevents the device from being used effectively in industrial settings. For example, when employing a diameter of 6 mm, as disclosed in EP-A-0 574 870, it is only possible to conduct a filament bundle consisting of not more than 100 filaments through the funnel since spinning bath liquid also has to flow through the funnel. This limits the spinneret to no more than 100 holes.

When a larger spinneret is used, i.e. one having thousands of spinning holes, such as described in Austrian Patent AT-B 397.392 of the present assignee, the diameter of the funnel pipe must be larger and a greater amount of spinning bath liquid must be discharged through the funnel pipe and circulated in the bath. The heavy flow of spinning bath liquid causes turbulent flows in the spinning bath, thereby interfering with the dry/wet- spinning process.

GB-A-1,017,855 discloses another device having a spinning funnel for dry/wet-spinning of synthetic polymers. Spinning bath liquid flows through the funnel, parallel to the flow of the extruded fibers. The spinneret is located approximately 0.5 cm above the spinning bath surface.

In view of the problems discussed above, it is an object of the present invention to provide a spinning device which achieves "good spinnability" (high spinning safety) without complex equipment. "Good spinnability" is defined as attaining a maximum final drawing as high as possible (minimum titer) before the fiber breaks. Another indicator of "good spinnability" is the period of time during which spinning is possible without the occurrence of spinning deficiencies which require technical assistance. Moreover, even when using spinnerets having high hole densities, the adhesion of the fresh extruded filaments in the air gap is to be prevented, and a titer as constant as possible (low titer variations) is to be attained.

It is another object of the present invention to provide a spinning process and apparatus for a dry/wet spinning process whereby it is possible to perform the process with high spinning safety, simultaneously:

(a) to provide a small drawing space (air gap) and (b) to use spinnerets having a high hole density and allowing for a high dope throughput.

It is a further object of the invention to provide such spinning process and apparatus in which turbulent flow in the spinning bath is avoided and the apparatus is readily adjustable to accommodate spinnerets of various sizes.

SUMMARY OF THE INVENTION

In accordance with the present invention, spinning apparatus for carrying out an amine-oxide process according to the dry/wet-spinning process comprises a spinneret having spinning holes for extruding filaments, a blowing device for cooling the extruded filaments immediately after they are delivered from the spinning holes, an air gap which is measured as the distance of the spinneret to the surface of the spinning bath liquid, a container containing spinning bath liquid, and means provided in the spinning bath liquid for bundling the extruded filaments. The bundling means is located at such a distance from the spinneret that the angle ($\alpha$) formed by the filaments with respect to the vertical, i.e. perpendicular to the surface of the spinning bath liquid does not exceed 45° and the distance $d_0$ (mm) between adjacent spinning holes in the spinnerets, the distance h (mm) from the spinneret to the bundling means and the air gap l (mm) between the spinneret and the surface of the spinning bath fulfill the relationship:

$$0.1 + 0.0051 \leq 0.7 \cdot d_0 \cdot \frac{(h-1)}{h}$$

and wherein:

$$0.4\ mm \leqq d_0 \leqq 2\ mm\ and$$

$$0\ mm < 1 < 60\ mm.$$

In a preferred embodiment, the angle a does not extend 20°.

It is known from WO 95/04173 of the present assignee that when using spinnerets having a high hole density, it is necessary to cool the freshly extruded filaments immediately after being delivered by the spinning holes. As will be described in detail hereinafter, the spinneret assembly disclosed in WO 95/04173 comprises a substantially rotationally symmetrical nozzle body having in its center an inlet for cooling gas, an inlet for the cellulose solution, an annular spinning insert having spinning holes and a baffle plate for diverting the cooling gas flow towards the filaments which are extruded from the spinning holes, so that the cooling gas stream hits the filaments essentially at right-angles. This arrangement enables spinning with a still higher hole density while at the same time effectively preventing adhesion of the freshly extruded filaments in the air gap.

In a further aspect, the invention comprises a non-rotating means provided within the container for both bundling and diverting the filaments. The non-rotation feature serves to prevent torn-off filaments from wrapping around the bundling and diverting means, thus facilitating the operation of the amine-oxide process. In a preferred embodiment, the bundling and diverting means comprises a generally cylindrical center body portion, terminated by two substantially circular flanks or flanges. The planes of the flanks encompass an angle of from 7° to 30°. This embodiment is particularly appropriate for starting the spinning operation, as will be explained below.

In another preferred embodiment of the spinning apparatus, the container holding the spinning bath liquid is connected to a lifting device whereby the container can be moved towards and away from the spinneret in a vertical direction in order to vary the air gap distance l. The position of the diverting body is fixed so that the distance h remains constant in spite of this movement.

Preferably, spinning bath liquid is introduced via an inlet at the lower end of the container, and an outlet for the liquid provided at the upper end of the container. A baffle plate within the container minimizes turbulence.

As noted above, it is of vital importance for the spinning safety in the dry/wet-spinning process that the drawing angle a in the air gap is as small as possible, less than 45° and preferably not more than 20°. The drawing angle is the angle formed by the outermost filament or edge filament of a bundle of filaments being delivered by the spinneret to a line vertical to a plane formed by the bottom of the spinneret. In accordance with one aspect of the invention, the appropriate drawing angle may be set, regardless of the size of the spinneret used, to reduce the risk of adhesion between individual filaments in the space between the spinneret and the surface of the spinning bath. This is achieved by providing, in the spinning bath, a bundling and diverting means that is vertically movable towards and away from the spinneret, enabling optimization of the angle $\alpha$.

DETAILED DESCRIPTION OF THE PREFERRED EMBODIMENTS

Figure 1:
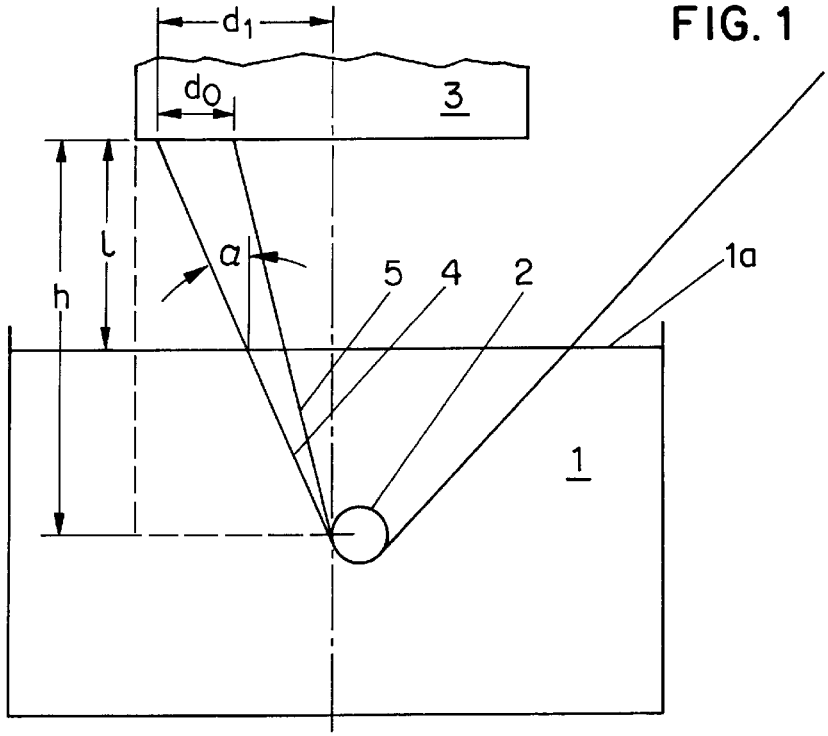
FIG. 1 shows the basic arrangement of a spinning apparatus for carrying out a dry/wet-spinning process according to the invention.

The basic spinning apparatus is shown schematically is FIG. 1. A container 1 holds spinning bath liquid having a top surface 1*a*. During a spinning operation, dope or solution comprising cellulose in an aqueous tertiary amine-oxide is extruded through a spinneret 3. The extruded filaments 4, 5 are drawn across an air gap 1 (the distance from the bottom of the spinneret 3 to the top surface la of the spinning bath liquid) and into the spinning bath liquid, wherein they coagulate. The filaments are bundled at member 2. The angle formed by a filament 4 with the vertical, i.e. perpendicular to the surface of the spinning bath liquid, is indicated by a. Member 2 may function as both a bundling and diverting means, whereby the bundled filaments are drawn diagonally upwards, as shown in the Figure.

Figure 6:
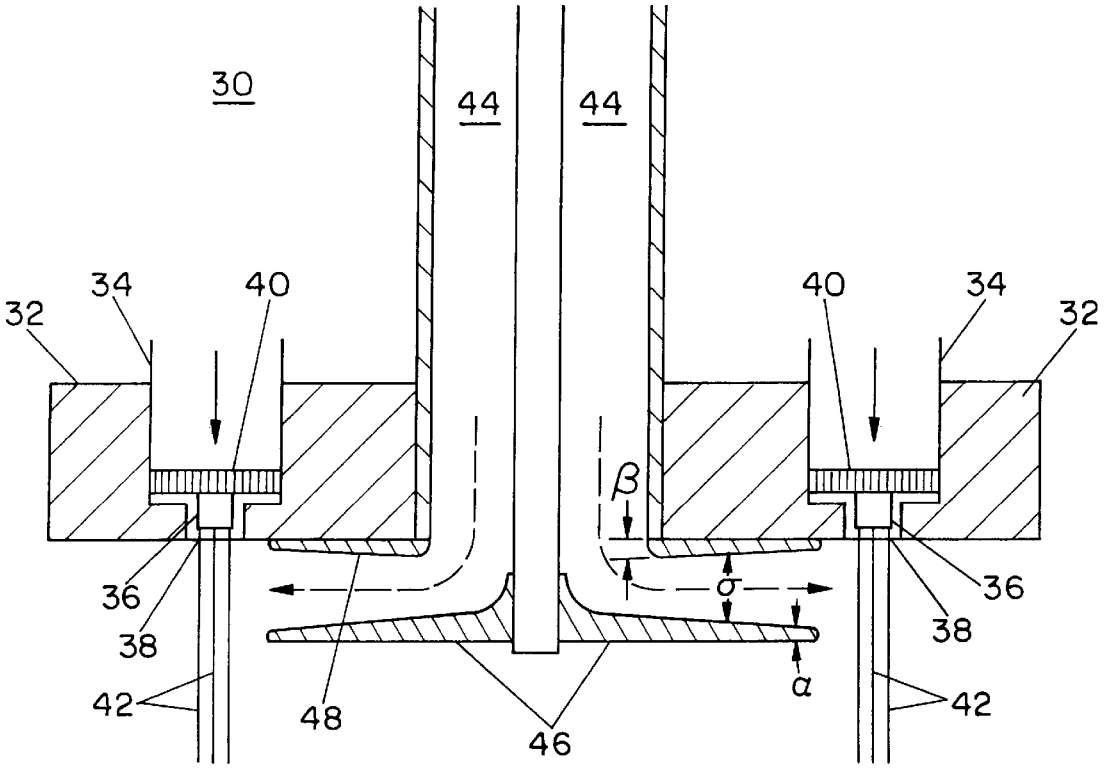
FIG. 6 is a cross-section of a spinneret having an annular spinning insert and blowing device in accordance with the invention.
Figure 7:
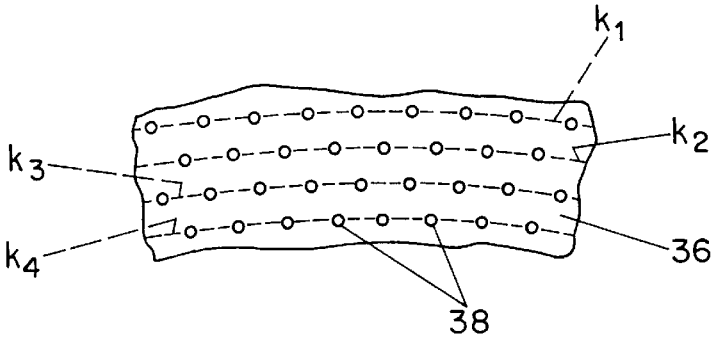
FIG. 7 is a portion of the face of an annular spinning insert having evenly spaced spinning holes.

In the case of an annular spinneret (such as illustrated in FIGS. 6 and 7), the reference number 4 denotes a filament delivered from a spinning hole located closest to the outermost edge of the spinneret 3, the ring formed by the outermost spinning holes on the spinneret having a diameter $d_1$. The distance from the center of this spinning hole to the center of its neighboring spinning hole, which delivers filament 5, is denoted by $d_0$. The vertical distance between the bundling and diverting means 2 and the face of the spinneret 3 is designated by h.

In accordance with the invention, the angle a should not exceed 45° and the distance between adjacent spinning holes in the spinneret, $d_0$ (mn), the distance from the spinneret to the bundling and diverting means, h (mm) and the air gap between the spinneret and the surface of the spinning bath liquid, 1 (mm), are selected in accordance with the following:

$$0.1 + 0.0051 \leq 0.7 \cdot d_0 \cdot \frac{(h-1)}{h},$$

wherein:

$0.4\ mm \leqq d_0 \leqq 2\ mm$ *and*

$0\ mm < 1 < 60\ mm.$

In a preferred embodiment, the angle a does not exceed 20°.

Figure 2:
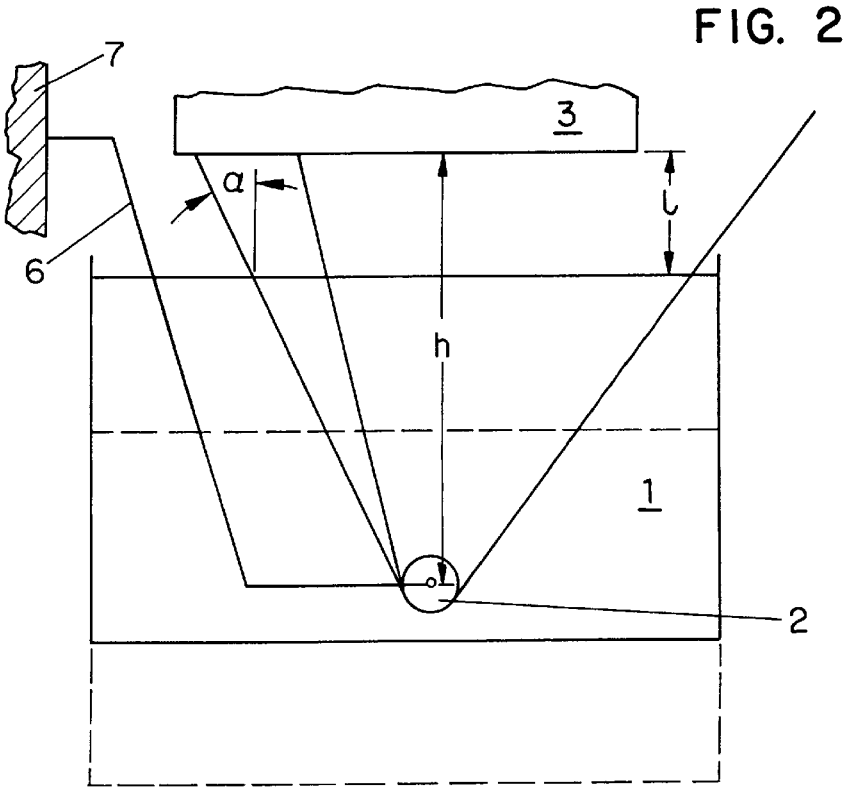
FIG. 2 illustrates schematically a spinning apparatus according to the invention, in which the diverting body is fixed in position and the spinning bath container is vertically movable.

In FIG. 2 the basic spinning apparatus of FIG. 1 is shown and like reference numbers are used as appropriate. For reasons to be discussed in detail below, diverting body 2 is non-rotatable and is connected to a fixed support 7 such as a wall, by means of a rigid arm 6 not connected to the container 1. Lifting or lowering the container 1 between the positions shown in dotted and full line will not move the bundling and diverting means. With this arrangement, it is evident that when the container 1 is lifted or lowered, the air gap 1 can be shortened or lengthened, while distance h remains constant.

Figure 3:
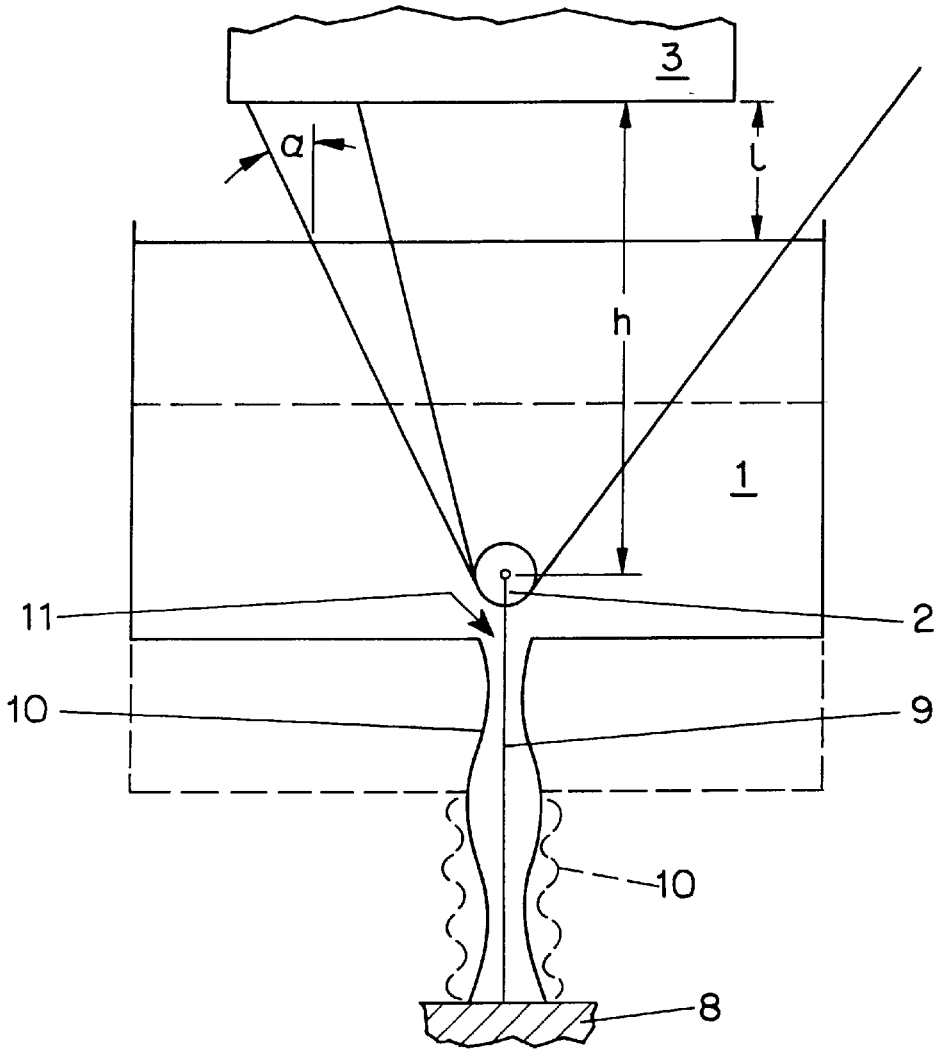
FIG. 3 shows a variation of the spinning apparatus of FIG. 2, in which the diverting body is anchored to the ground by a rigid arm.

In the embodiment of FIG. 3, the bundling and diverting means 2 is anchored to the ground 8 by means of a rigid arm 9. The arm 9 rises through an appropriate opening 11 provided in the bottom of container 1. A flexible sealing jacket 10 is provided to prevent liquid from being lost from the container 1. The sealing jacket 10 folds, accordion-style, when the container 1 is lowered.

In FIGS. 2 and 3, means for lowering and raising the container 1 are not shown, but it is understood that suitable mechanism, hydraulic or electric-motor driven, for example, may be used.

In both the embodiments of FIGS. 2 and 3, the distance h between the bundling and diverting means and the spinneret is fixed. This distance is selected, in conjunction with the size of the spinneret so that the angle a is less than 45° and preferably less than 20°. The spinning bath container is set at a level such that the distance l satisfies the aforementioned relationships.

Figure 4:
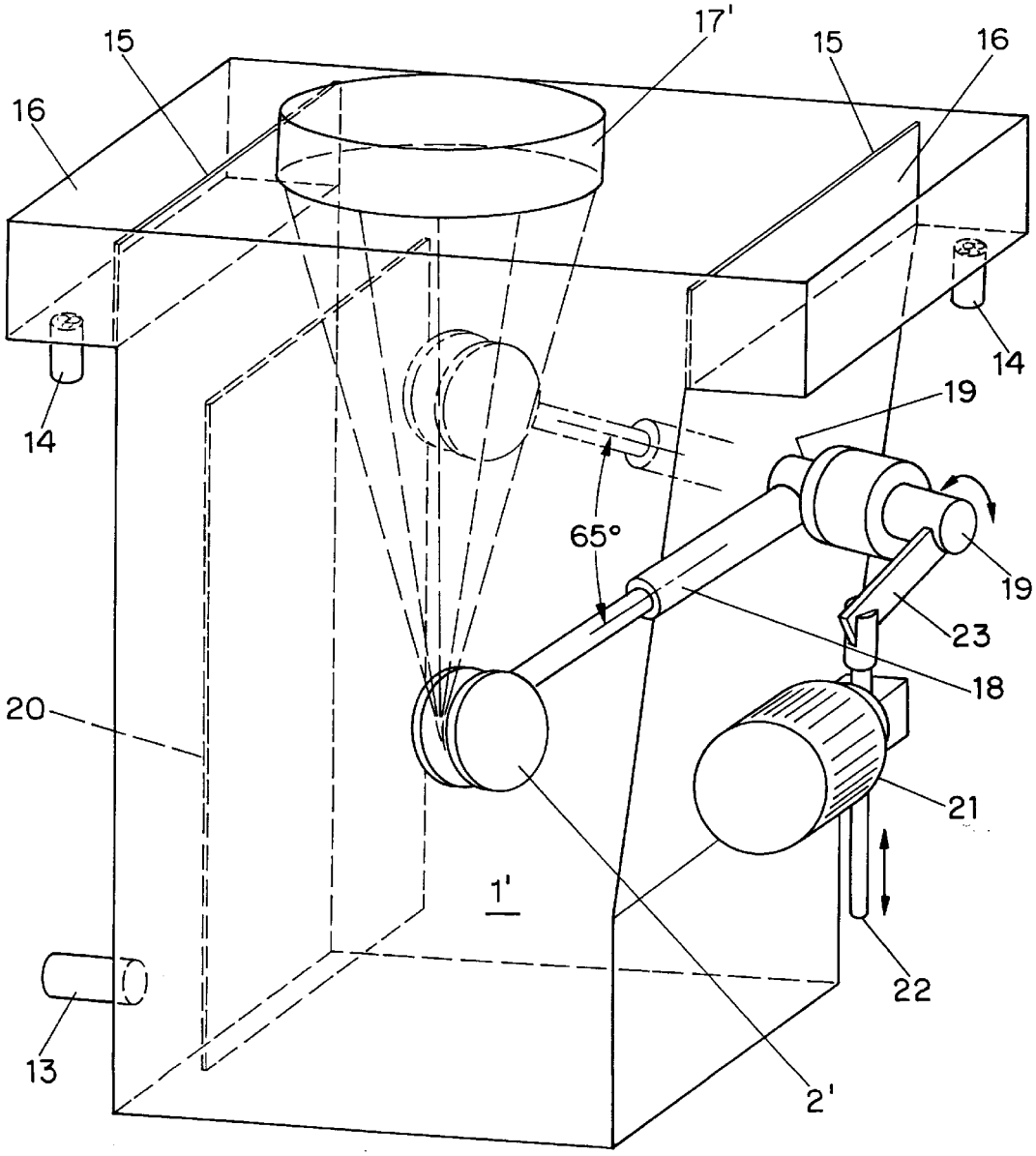
FIG. 4 illustrates another embodiment of the spinning apparatus according to the invention in which the diverting body is vertically movable within the container holding the spinning bath liquid.

In the embodiment of FIG. 4, the spinning bath container 1' remains fixed and the distance between the bundling and diverting means 2' and the face of the spinneret is adjusted by moving means 1' vertically.

The spinning bath liquid is fed through inlet 13 provided at the lower end of the container 1'. The spinning bath liquid flows upwards to fill the container. When the container 1' is filled, the spinning bath liquid will overflow into collecting cups or troughs 16 across overflow edges 15 at both sides of the container and thus a constant liquid level will be maintained in the container 1'.

The spinning bath liquid which overflows into collecting cups 16 is discharged through outlets 14 and recirculated to the container 1' through the inlet 13 by means of an external pumping system (not shown). The outlets 14 are provided with filters to filter out undesirable filament residue.

In order to reduce turbulent flow in the spinning bath as much as possible, a baffle plate 20 is provided within the container 1'. The baffle plate 20 is mounted parallel to the wall of the container by internal supports (not shown).

Numeral 17' denotes a spinning assembly, preferably of the type shown in FIGS. 6 and 7 and described hereinafter, having an annular spinneret.

After the filaments are extruded from the spinneret, they are bundled and diverted by the non-rotatable means 2' and drawn upwards by suitable drawing means (not shown). The bundling and diverting means 2' is attached to a rotatable axle 19 by means of an arm 18. The axle 19 is rotatably fastened through a lateral wall of the container 1' and sealed, to prevent leakage of spinning bath liquid. Operation of bi-directional electric motor 21 rotates axle 19 by raising or lowering member 22 which is pivoted at one end of eccentric arm 23, the other end of which is fixed to shaft 19.

FIG. 4 shows in solid line the lower final position of the means 2', wherein the distance to the surface of the spinning bath liquid is largest. The upper final position of the bundling and diverting means 2', wherein the distance to the surface of the spinning bath liquid is smallest, is illustrated in dotted line. The maximum angle by which the means 2' is moved is 65°.

The spinning device according to the invention allows the drawing angle a to be as small as possible, regardless of the width of spinneret in assembly 17'. When a wide spinneret is used the drawing angle $\alpha$ can be reduced by moving the arm 18 downward, thus increasing the spinning safety. When a smaller spinneret is used, the body 2' may be positioned nearer to the surface of the spinning bath liquid.

A further advantage of the apparatus of the invention is that the spinning operation can be started more easily. At the start, the bundling and diverting means 2' is moved to its upper position as shown in dotted line. The filaments delivered by the spinneret are bundled and passed along the underside of means 2' to the drawing means (not shown). The air gap 1 is then set by moving means 2' downwards by actuation of motor 21. As the bundling and diverting means 2' lowers, the angle a of the filaments decreases and its final position is set according to the relationships specified hereinabove to achieve the desired angle.

Figure 5:
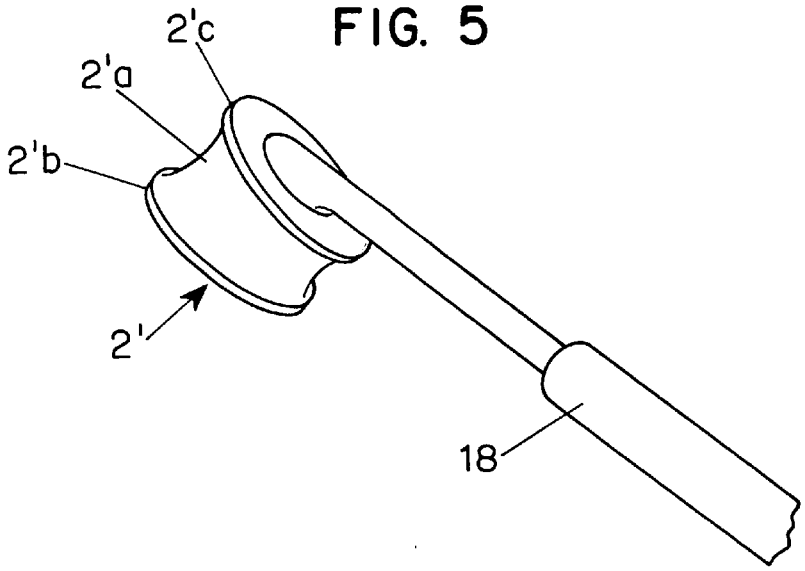
FIG. 5 is a perspective view showing the shape of the diverting body.

Bundling of the filaments is carried out more easily with the bundling and diverting means 2' in its upper position since the extruded filaments first contact a portion of the means 2' having a larger spacing distance between the flanks 2'b and 2'c. As seen in FIG. 5, the generally cylindrical body portion 2'a of the means 2' is between the two substantially circular flanks 2'b and 2'c lying in planes angularly disposed to each other, to encompass an angle of between 7° and 30°. The orientation of 2' with respect to arm 18 is arranged so that with 2' in its upper position, the underside presented has the greatest distance between flanks. After the bundle of filaments are passed along the underside, the bundling and diverting means is lowered by rotation of the axle 19 towards its lower position. As it moves downward, its orientation changes so that the distance between its flanks at its underside decreases, thereby bundling the filaments more closely together. The diverted filament bundle is now more readily passed to a drawing means provided downstream (not shown) and with a predetermined drawing rate, the desired titre is adjusted.

A similarly shaped bundling and diverting means may be used in the embodiments of FIGS. 2 and 3.

FIGS. 6 and 7 illustrate a preferred embodiment of a spinneret assembly for use in the spinning apparatus of the invention, as described in WO 95/04173. Such an assembly is indicated schematically by the numeral 3 in FIGS. 1–3 and 17 in FIG. 4. The assembly 30 includes a heatable spinneret die body 32 which is supplied with spinning material through an inlet 34. Annular deep-drawn spinning insert 36, having spinning holes 38, is supported in the die body 32. A filter ring 40 is positioned above the spinning insert 36. The filter ring 40 and the spinning insert 36 are sealed against the die body.

FIG. 7 is a partial view of the face of spinning insert 36, showing the spinning holes 38 formed therein. The spinning holes 38 are located on four circles $k_1$, $k_2$, $k_3$ and $k_4$. The spinning holes 38 are uniformly spaced from one another.

In an exemplary embodiment, the spinning insert 36 is made of an alloy of 70% gold and 30% platinum, and has a diameter of 135 mm and a thickness of 1 mm. The distance between the spinning holes is uniform at 0.50 mm and there are more than 15,000 spinning holes.

The inlet 34 for the spinning material can have an annular design; however, it is possible to feed the die body 32 with spinning material at just one point provided that the die body 32 is designed so that the spinning material can be uniformly distributed over the entire spinning insert 36.

During a spinning operation, a plurality of annularly arranged filaments 42 is extruded from the spinning holes 38. The filaments 42 pass across an air gap l into the precipitation bath and are then drawn. In the air gap, the extruded filaments 42 are cooled. Drawing is achieved by drawing off the filaments 42 at a greater velocity than that at which they leave the spinning holes 38.

In the air gap, a cooling gas, preferably air, is supplied under pressure at inlet 44, strikes baffle plate 46 and is deflected in an essentially horizontal direction, as shown by the dotted-line arrows, to establish a laminar air flow. The annularly arranged filaments 42 are cooled by the laminar air stream blowing from the inside to the outside in a direction which is essentially perpendicular to the direction of travel of the filaments. The cooling air emerges from the annular opening formed by the baffle plate 46 and the opposing face 48. Insulation is preferably provided between the inlet 44 for the cooling gas and the inlet 34 for the spinning material to prevent heat transfer from the spinning material to the cooling air.

FIG. 7 shows the uniform spacing of the spinning holes 38 on the spinning insert 36. The uniform spacing of the spinning holes 38 minimizes turbulence in the cooling gas stream as it passes through the filaments and the absence of turbulence has a positive effect on the spinning process and on the properties of the resulting cellulose fibers By way of the following Examples 1, 2, 3 and 4, the invention will be described in still more detail, Examples 1 and 2 revealing the effect of angle α on the spinnability of cellulose solutions. Example 4 demonstrates the advantageous effect of the non-rotatable diverting body on spinnability.

EXAMPLE 1

The spinning apparatus substantially as shown in FIG. 1 was used, with the spinneret assembly of FIGS. 6 and 7; however, the extruded filaments were bundled with a spinning funnel according to EP-A-0 574 879.

The spinneret (number of holes: 3960; hole diameter: 100 μm; external diameter of the nozzle (outermost row of holes) $d_1$: 145 mm) exhibits a substantially rotationally symmetrical nozzle body having in its center an inlet for cooling gas, an inlet for cellulose solutions (13.5% of cellulose; temp.: 120° C.), an annular, deep-drawn spinning insert of precious metal having spinning holes, and a baffle plate to direct a cooling gas stream to cellulose filaments which are extruded from the spinning holes (output: 0.025 g/min), so that the cooling gas stream (24 $m^3$/h) strikes the extruded cellulose filaments substantially at right angles. The spinning holes in the spinning insert are spaced substantially at identical distances from each other (hole/hole-distance do: 1000 μm).

The air gap l had a length of 15 mm. The air in the air gap had a temperature of 24.5° C. and a water content of 4.5 g of water/kg of air.

Several spinning tests were carried out, varying distance h of the bundling point of the funnel (boundary between the cylindrical pipe to the funnel itself) to the spinneret surface in such a way that the relation $$0.1 + 0.0051 \leq 0.7 \cdot d_0 \cdot \frac{(h-1)}{h}$$

(l=15 and $d_0$=1000) was fulfilled, while the air gap 1 remained unchanged. In each test, the highest achievable final drawing, i.e. the maximum drawing rate of the filaments at breaking of the fiber, was measured. The results are shown in Table 1:

TABLE 1

| h (mm) | Angle α | final drawing (m/min) |
|---|---|---|
| 240 | 16.8° | 43 |
| 190 | 20.9° | 42 |
| 140 | 27.4° | 42 |
| 90 | 38.8° | 41 |
| 70 | 46.0° | 29 |
| 40 | 61.1° | 0 |

From Table 1 it can be seen that up to an angle α of about 40° no reduction of the final drawing rate, and thus no deterioration of spinnability, can be observed. From an angle α of 45° onwards however, the maximum final drawing rate is significantly reduced. At an angle of about 61°, the solution is no longer spinnable.

EXAMPLE 2

A spinning apparatus corresponding to FIG. 2 was used, and again the spinneret shown in FIGS. 6 and 7 (number of holes: 28 392; hole diameter: 100 μm; external diameter of the nozzle (outermost row of holes) $d_1$: 155 mm; hole/hole-distance do: 500 μm) was used.

The cellulose solution contained 13.5% of cellulose and had a temperature of 120° C. The output was 0.025 g/min. The air gap l had a length of 20 mm. The air in the air gap had a temperature of 12° C. and a water content of.5 g. of water/kg of air.

The filaments were diverted at a non-rotatable bundling and diverting means and drawn diagonally upwards from the spinning bath.

While air gap 1 remained unchanged, distance h was varied, and the maximum final drawing rate and angle a were determined. The results are given in Table 2.

TABLE 2

| h (mm) | Angle α | final drawing (m/min) |
|---|---|---|
| 345 | 13° | 18 |
| 165 | 25° | 18 |
| 115 | 34° | 18 |
| 75 | 46° | 4 |

As can be seen from Table 2, when changing the angle α in a range of from 13° to 34°, the maximum final drawing rate will not be reduced. However, when increasing-the angle α to 46°, the final drawing rate, i.e. the spinnability, is drastically reduced. When distance h is further reduced (and thus the angle a increased), the solution is no longer spinnable.

EXAMPLE 3

The same spinning apparatus as described in Example 2 was used, the air gap l however was held constant at 30 mm.

Distance h was again varied. The spinning safety of the solution under the given conditions was determined according to the occurrence of spinning deficiencies (i.e., filament break, adhesion of the filaments).

The spinning safety is high when in a period of time of more than 15 minutes practically no spinning deficiencies will occur. When spinning deficiencies abound within a period of 15 minutes or even before, spinning at an industrial scale is only possible when continuous technical assistance is provided.

Consequently, the spinning safety may be defined by a time indication. In the following Table 3, the indication ">15 min" means that spinnability was good (practically no spinning deficiencies within 15 minutes). An indication of e.g. "<10 min" means that in less than 10 minutes after spinning start, massive spinning deficiencies which require an interruption of spinning will occur.

TABLE 2

| h (mm) | Angle α | Spinning safety |
|---|---|---|
| 345 | 13° | >15 min |
| 165 | 25° | >15 min |
| 115 | 34° | >15 min |
| 100 | 38° | 10–15 min |
| 85 | 42° | <10 min |

From Table 3 it can be seen that the spinnability is good when the distance h is greater than 115 mm. However, when h is less than 115 mm, the relation defined according to the invention is not fulfilled and spinnability deteriorates drastically. This is the case for the last two tests. The deterioration of the spinning behavior occurred at an angle α below 45°.

EXAMPLE 4

In a pilot plant for the production of cellulose fibers according to the amine-oxide process, the way in which the filaments are diverted in the spinning of the apparatus of the invention was examined in numerous individual tests.

Rotatable diverting means of many designs (rolls including glass sticks having a smooth or ribbed surface) were tested. In these tests, it was repeatedly found that, as soon as a diverting means rotates around its own axis, the filaments will wrap around it within a short period of time. The wrapping around occurs because spun filaments sometimes break. The broken filaments are then collected by the rotating diverting means and eventually wrap completely around it. Thus, good spinnability is not obtained because the filaments wrapped around the diverting means must be removed by means of mechanical intervention. For example, it has been shown that when using a rotatable diverting means, the spinning process has to be interrupted in a period of time of less than 30 minutes to remove the filaments wrapped around it.

In view of these problems and to guarantee a satisfactory spinning operation, it is necessary to design, if possible, a diverting means which does not rotate. The use of a non-rotating diverting means, as disclosed herein, allows one to maintain a continuous spinning process for several hours.

The foregoing description of the preferred embodiment of the invention has been presented only for purposes of illustration and description. The foregoing description is not intended to limit the invention to the precise form disclosed, and modifications and variations of the disclosed embodiment should be apparent to those of ordinary skill in the art.

We claim:

1. Spinning apparatus for carrying out a dry/wet-spinning process for a solution of cellulose in an aqueous tertiary amine-oxide comprising:

a spinneret having spinning holes for extruding filaments;

a container containing spinning bath liquid;

an air gap between said spinneret and the upper surface of said spinning bath liquid.

a blowing device for cooling said extruded filaments in said air gap immediately after being extruded from the spinning holes; and means in said spinning bath liquid for bundling said extruded filaments;

wherein said bundling means is located at a distance from said spinneret such that an angle α formed by the filaments with respect to the vertical does not exceed 45° and that the relation $$0.1 + 0.0051 \leq 0.7 \cdot d_0 \cdot \frac{(h-1)}{h}$$

is fulfilled, wherein $d_0$ is the distance (mm) between a spinning hole and its neighboring spinning hole on said spinneret, h is the distance (mm) of said diverting means to said spinneret and l is said air gap (mm), and wherein $$0.4\ mm \leqq d_0 \leqq 2\ mm\ and$$

$$0\ mm < 1 < 60\ mm.$$

2. Spinning apparatus according to claim 1 wherein said bundling means includes means for diverting said extruded filaments.

3. Spinning apparatus according to claim 2, wherein said bundling and diverting means does not rotate when bundling and diverting the filaments.

4. Spinning apparatus according to claim 2, wherein said bundling and diverting means comprises a substantially cylindrical body portion between two substantially circular flanks.

5. Spinning apparatus according to claim 4, wherein the planes formed by said flanks make an angle of from 7° to 30° with each other.

6. Spinning apparatus according to claim 1, wherein said angle a does not exceed 20°.

7. Spinning apparatus according to claim 1, wherein said container containing the spinning bath liquid is vertically movable towards and away from the spinneret to vary the air gap l and said diverting means is supported within said container such that the distance h remains constant regardless of the movement of said container.

8. Spinning apparatus according to claim 1, wherein said bundling means is vertically movable.

9. Spinning apparatus according to claim 1, wherein said container comprises:

an inlet for the introduction of the spinning bath liquid into the container, said inlet being provided at a lower end of said container; and an outlet for the spinning bath liquid provided at an upper part of said container.

10. Spinning apparatus according to claim 1, wherein said spinneret comprises:

a substantially rotationally symmetrical nozzle body having in its center an inlet for cooling gas;

an inlet for the cellulose solution, an annular spinning insert having spinning holes; and a baffle plate for directing the flow of cooling gas towards the filaments which are extruded from the spinning holes, so that the cooling gas stream strikes the filaments substantially at right angles.

11. Spinning apparatus for carrying out a dry/wet-spinning process for a solution of cellulose in an aqueous tertiary amine-oxide comprising:

a spinneret having spinning holes for extruding filaments;

a container containing spinning bath liquid;

an air gap between said spinneret and the upper surface of said spinning bath liquid;

a blowing device for cooling said extruded filaments in said air gap immediately after being extruded from the spinning holes; and means provided in said spinning bath liquid for bundling said extruded filaments said bundling and diverting means being non-rotatable; and wherein said bundling means is located at a distance from said spinneret such that an angle $\alpha$ formed by the filaments with respect to the vertical does not exceed 45°.

12. Spinning apparatus according to claim 11 wherein said bundling and diverting means is vertically movable within said container.

13. Spinning apparatus according to claim 11 wherein said bundling and diverting means comprises a generally cylindrical body portion between two substantially circular flanks.

14. Spinning apparatus according to claim 13, wherein the planes of said flanks include an angle of from 7° to 30°.

15. Spinning apparatus according to claim 11, wherein said bundling diverting means is located at a distance from said spinneret such that the angle a formed by the filaments with respect to the vertical does not exceed 20°.

16. Spinning apparatus according to claim 11 wherein said container includes an inlet for spinning bath liquid at its lower end and an outlet for said liquid at its upper end.

17. For use in a dry/wet spinning process in which dope is extruded into filaments through a spinneret having a high spinning hole density into a gaseous medium and then into spinning bath liquid;

a container for said spinning bath liquid; and means in said container for bundling and diverting the filaments wherein said bundling means is located at a distance from said spinneret such that an angle $\alpha$ formed by the filaments with respect to the vertical does not exceed 45°, said bundling and diverting means being vertically moveable.

18. The apparatus according to claim 17 wherein said bundling and diverting means comprises a generally cylindrical body portion between two substantially circular flanks.

19. The apparatus according to claim 18 wherein the planes of said flanks include an angle of from 7° to 30°.

20. The apparatus according to claim 17 wherein said bundling and diverting means is non-rotatable.

21. The apparatus according to claim 17 wherein said container includes an inlet for spinning bath liquid at its lower end and an outlet for said liquid at is upper end.

22. The apparatus according to claim 21 further comprising baffle means within said container for reducing turbulence in the spinning bath liquid in said container.

* * * * *

UNITED STATES PATENT AND TRADEMARK OFFICE

CERTIFICATE OF CORRECTION

PATENT NO. : 5,984,655

DATED : November 16, 1999

INVENTOR(S) : Schwenninger et al.

It is certified that error appears in the above-identified patent and that said Letters Patent is hereby corrected as shown below:

IN THE CLAIMS:

Column 10, line 45: "angle a" should read -- angle α --;

Column 10, line 66: "solution, an" should read -- solution; ¶an --;

Column 11, line 17: "filaments said" should read -- filaments, said --;

Column 11, line 32: "bundling diverting" should read -- bundling and diverting --;

Column 12, line 1: "angle a" should read -- angle α --;

Column 12, line 27: "is" should read -- its --;

IN THE SPECIFICATION:

Column 3, line 20: "*and*" should read -- and --;

Column , line : "angle a" should read -- angle α --;

Column 3, line 23: "angle a" should read -- angle α --;

UNITED STATES PATENT AND TRADEMARK OFFICE

CERTIFICATE OF CORRECTION

PATENT NO. : 5,984,655
DATED : November 16, 1999
INVENTOR(S) : Schwenninger et al It is certified that error appears in the above-indentified patent and that said Letters Patent is hereby corrected as shown below:

Column 3, line 23: "extend" should read -- exceed --;

Column 3, line 65: "a" should read -- α --;

Column 4, line 49: "a." should read -- α. --;

Column 4, line 64: "angle a" should read -- angle α --;

Column 4, line 66: "(mn)," should read -- (mm), --;

Column 5, line 10: "*and*" should read -- and --;

Column 5, line 12: "angle a" should read -- angle α --;

Column 5, line 16: "diverting body 2" should read -- diverting body 2 --;

Column 5, line 17: "fixed support 7" should read -- fixed support 7 --;

Column 5, line 39: "angle a" should read -- angle α --;

Column 6, line 16: "angle a" should read -- angle α --;

Column 6, line 30: "angle a" should read -- angle α --;

UNITED STATES PATENT AND TRADEMARK OFFICE

CERTIFICATE OF CORRECTION

PATENT NO. : 5,984,655

DATED : November 16, 1999

INVENTOR(S) : Schwenninger et al

It is certified that error appears in the above-indentified patent and that said Letters Patent is hereby corrected as shown below:

Column 7, line 61: "do" should read -- $d_0$ --;

Column 8, line 33: "28 392;" should read -- 28,392; --;

Column 8, line 35: "do" should read -- $d_0$ --;

Column 8, line 39: "of.5 g." should read -- of .5 g --;

Column 8, line 45: "angle a" should read -- angle $\alpha$ --;

Column 8, line 59: "increasing-the" should read -- increasing the --;

Column 8, line 62: "angle a" should read -- angle $\alpha$ --;

Column 9, TABLE 2 (sic): "TABLE 2" should read -- TABLE 3 --;

Signed and Sealed this

Seventeenth Day of April, 2001

*Attest:*

Nicholas P. Godici

NICHOLAS P. GODICI

*Attesting Officer*

*Acting Director of the United States Patent and Trademark Office*